US005166017A

United States Patent [19]

Hoshizaki et al.

[11] Patent Number: 5,166,017

[45] Date of Patent: Nov. 24, 1992

[54] ELECTROPHOTOGRAPHIC PHOTORECEPTOR

[75] Inventors: Taketoshi Hoshizaki; Fumio Ojima; Masahiko Hozumi; Kazuyuki Nakamura; Kiyokazu Mashimo, all of Kanagawa, Japan

[73] Assignee: Fuji Xerox Co., Ltd., Tokyo, Japan

[21] Appl. No.: 291,464

[22] Filed: Dec. 28, 1988

[30] Foreign Application Priority Data

Jan. 7, 1988 [JP] Japan ..... 63-000724

[51] Int. Cl.[5] ..... G03G 5/047; G03G 5/087

[52] U.S. Cl. ..... 430/58; 430/96

[58] Field of Search ..... 430/58, 96

[56] References Cited

U.S. PATENT DOCUMENTS 4,314,015 2/1982 Hashimoto et al. ..... 430/58
4,446,217 5/1984 Takasu et al. ..... 430/964
4,717,636 1/1988 Takahashi et al. ..... 430/58
4,734,348 3/1988 Suzuki et al. ..... 430/96

FOREIGN PATENT DOCUMENTS 210846 9/1988 Japan ..... 430/96

*Primary Examiner*—Roland Martin
*Attorney, Agent, or Firm*—Finnegan, Henderson, Farabow, Garrett and Dunner

[57] ABSTRACT

An electrophotographic photoreceptor is disclosed, which comprises an electrically conductive substrate having thereon a charge generating layer and a charge transporting layer, said charge generating layer containing a resin binder and a charge generating material (selenium or an alloy of selenium), and said resin binder being a polyvinyl acetal resin and preferably a partially acetallized polyvinyl butyral resin. The electrophotographic photoreceptor according to the present invention has a photosensitivity which is less dependent on surface voltage.

9 Claims, 1 Drawing Sheet

ELECTROPHOTOGRAPHIC PHOTORECEPTOR

FIELD OF THE INVENTION

The present invention relates to an electrophotographic photoreceptor for electrophotography, and more particularly to a layered electrophotographic photoreceptor which comprises an electrically conductive substrate having layered thereon a charge generating layer containing (a) a charge generating material and a resin binder, and (b) a charge transporting layer.

BACKGROUND OF THE INVENTION

Known electrophotographic photoreceptors for use in electrophotography include those utilizing inorganic photoconductive substances, as well as those utilizing organic photoconductive substances (the latter will hereinafter be referred to as "organic electrophotographic photoreceptors"). Organic electrophotographic photoreceptors have been widely used because of advantages in productivity, cost, safety, etc. In recent years, in order to improve their electrophotographic properties, such as charge retention, repeat stability, response to light, spectral characteristics, mechanical strength, etc., there have been proposed various organic electrophotographic photoreceptors of the function separation type wherein functions of an electrophotography photoreceptor are separately borne by a plural elements In such organic electrophotographic photoreceptors of the function separation type, a charge generating layer and a charge transporting layer are formed on an electrically conductive substrate. It is known to use, as a charge generating material for the charge generating layer, such organic compounds as bis-azo pigments (as described in U.S. Pat. No. 4,314,015), condensed polycyclic quinone pigments (as described in JP-A-47-18544) (The term "JP-A" as used herein means an unexamined published Japanese patent application.), and the like.

However, organic electrophotographic photoreceptors utilizing such organic pigments are not satisfactory in sensitivity, spectral characteristics and repeat stability since organic pigments do not possess a flat spectral sensitivity and are capable of generating photo carriers only in low efficiencies.

It has been proposed in JP-A-52-120834 and JP-A-53-27033, in order to improve the above disadvantages, to use as a charge generator an inorganic photoconductive material, such as selenium or alloys of selenium, in particular, trigonal selenium, instead of organic pigments Such inorganic photoconductive materials are highly useful and capable of providing an electrophotographic photoreceptor which is excellent in such electrophotographic properties as photosensitivity, repeatstability, etc. However, conventional function separation type electrophotographic photoreceptors utilizing selenium or an alloy of selenium suffer from the disadvantage that the decay rate of their surface potential becomes lower with a decrease in voltage; namely, their photosensitivity is highly dependent on their surface potential.

SUMMARY OF THE INVENTION

Therefore, an object of the present invention is to provide an electrophotographic photoreceptor which is free from the above disadvantages.

Another object of the present invention is to provide an electrophotographic photoreceptor in which the dependence of its photosensitivity upon its surface potential can be improved while retaining both high sensitivity and stability.

The inventors have conducted intensive investigations on the ratio of selenium or alloys of selenium and resin binders to be used in a charge generating layer and on the kind of resin binders to be used therein. As a result, it has now been found that the above object can be obtained and the above disadvantages can be solved by a charge generating layer comprising selenium or an alloy of selenium in an amount of 30 to 80% by volume and a resin binder of a polyvinyl acetal resin. The invention has been completed on the basis of this finding.

Additional objects and advantages of the invention will be set forth in the description which follows, and in part will be apparent from the description, or may be learned by practice of the invention. The objects and advantages of the invention may be realized and obtained by means of the instrumentalities and combinations particularly pointed out in the appended claims.

To achieve the foregoing objects, and in accordance with the purposes of the invention as embodied and broadly described herein, there is provided an electrophotographic photoreceptor which comprises an electrically conductive substrate having layered thereon a charge generating layer and a charge transporting layer, wherein said charge generating layer comprises a resin binder in which is dispersed a charge generating material of selenium or an alloy of selenium, said resin binder is a polyvinyl acetal resin, and the content of selenium or alloy of selenium in said charge generating layer is from 30 to 80% by volume, based on the total volume of said layer.

BRIEF DESCRIPTION OF THE DRAWINGS

The accompanying drawings, which are incorporated in and constitute a part of the specification, illustrate a presently preferred embodiment of the invention and, together with the general description given above, and the detailed description of the preferred embodiment given below, serve to explain the principles of the invention.

DETAILED DESCRIPTION OF THE INVENTION

Reference will now be made in detail to the presently preferred embodiment of the invention as illustrated in the accompanying drawings.

Figure 1:
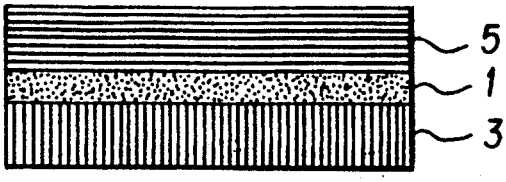
FIGS. 1 to 4 show schematic cross-sectional views of embodiments of electrophotographic photoreceptors according to the present invention.

FIG. 1 shows an electrophotograhpic photoreceptor which comprises an electrically conductive substrate 3 having a charge generating layer 1 thereon and a charge transporting layer 2 on the charge generating layer 1.

Figure 2:
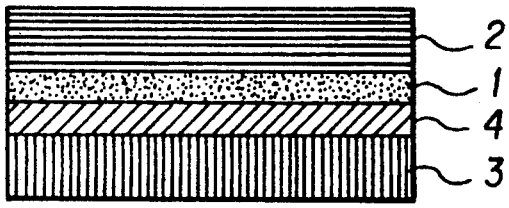

In another embodiment shown in FIG. 2, an undercoating layer 4 is provided between an electrically conductive substrate 3 and a charge generating layer 1.

Figure 3:
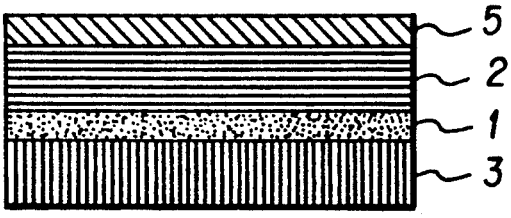

In FIG. 3, a protective layer 5 is additionally formed on the surface of a charge transporting layer 2.

Figure 4:
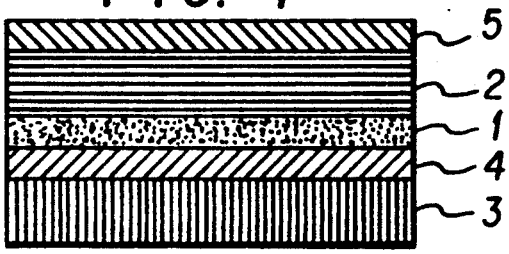

In another embodiment shown in FIG. 4, an undercoating layer 4 is provided between an electrically conductive substrate 3 and a charge generating layer 1, and a protective layer 5 is formed on a charge transporting layer 2 which was positioned on the charge generating layer 1.

The following is an explanation of each of the layers constituting the electrophotographic photoreceptor of the present invention.

There can be used, in the electrophotographic photoreceptor of the present invention, any known electrically conductive substrate, including drums and sheets of such metals as aluminum, copper, iron, zinc and nickel, as well as drums, sheets and plates of paper, plastics or glass having thereon a conductive layer formed, e.g., by depositing a metal, such as aluminum, copper, gold, silver, platinum, palladium, titanium, nickel-chromium, stainless steel, copper-indium, etc., or a conductive metal compound, such as indium oxide, tin oxide, etc.; by laminating a metal foil; or by coating a dispersion of a resin binder containing conductive particles, such as carbon black, powders of indium oxide, tin oxide or antimony oxide, and powders of metals. It is to be understood that conductive materials to be used in the present invention are not limited to these.

Where desired, the surface of the electrically conductive substrate can be subjected to various treatments, for example, surface oxidation, chemical treatment or coloring, if such a treatment does not adversely affect the quality of images obtained.

An undercoating layer can be formed between the electrically conductive substrate member and a charge generating layer. At the time when the electrophotographic photoreceptor having a layered structure is charged, the undercoating layer hinders the electric charge from being injected from the electrically conductive substrate into the photosensitive layer. At the same time, the undercoating layer functions as an adhesive layer to securely retain the photosensitive layer on the electrically conductive substrate in an integrated manner and, in some cases, performs the function of preventing the reflection of light on the surface of the electrically conductive substrate.

In the udnercoating layer, there can be used known resin binders, including, e.g., polyethylenes, polypropylenes, polyacrylates, polymethacrylates, polyamides, polyvinyl chlorides, polyvinyl acetates, phenolic resins, polycarbonates, polyurethanes, polyimides, polyvinylidene chlorides, polyvinyl acetals, vinyl chloride-vinyl acetate copolymers, polyvinyl alcohols, water-soluble polyesters, nitrocelluloses, caseins, gelatin, and the like. Among these, polyamides are preferably used.

The thickness of the undercoating layer is preferably from 0.01 to 10 μm, and more preferably from 0.05 to 2 μm.

The charge generating layer in the electrophotographic photoreceptor of the present invention comprises selenium or an alloy of selenium dispersed into a polyvinyl acetal resin, the content of selenium or selenium alloy being from 30 to 80% by volume, and preferably from 40 to 70% by volume, based on the total volume of the charge generating layer. If the content is less than 30% by volume, a poor repeatstability will result, whereas if it exceeds 80% by volume, a charge generating layer will result having an inferior adhesiveness as a film.

Examples of selenium or alloys of selenium to be used as a charge generating material in the charge generating layer of the present invention, are amorphous selenium, trigonal selenium, selenium tellurium alloys, selenium-tellurium-arsenic alloys, and mixtures of these. Trigonal selenium is particularly preferred.

As stated above, polyvinyl acetal resins are used as a binder in the charge generating layer. It is preferred to use polyvinyl acetal resins composed of the following monomer units (A), (B) and (C):

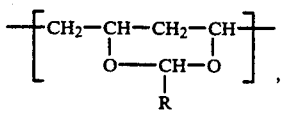

(A)

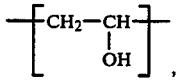

(B)

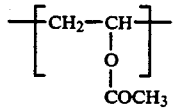

(C)

in which R represents a hydrogen atom; an alkyl group, preferably having from 1 to 10 carbon atoms, such as methyl, ethyl, n-propyl, isopropyl, etc.; or an aryl group, preferably having from 6 to 20 atoms.

In the polyvinyl acetal resins, monomer unit (A) is contained preferably within the following ranges: 60 mol %≦(A)≦75 mol %; A is preferably from 60 to 75 mol %, B is preferably from 20 to 39 mol % and C is preferably from 1 to 5 mol %.

Examples of such polyvinyl acetal resins include polyvinyl formals, polyvinyl butyrals, polyvinyl isobutyrals, and partially acetallized polyvinyl butyrals in which a part of the butyral groups contained therein is substituted with one or more members selected from the group consisting of formal, acetoacetal and propional. It is particularly preferred to use partially acetoacetallized polyvinyl acetal resins.

In order to disperse the above-described selenium or alloys of selenium into a polyvinyl acetal resin, any conventional method can be used, including the ball mill method, attriter method, sand mill method, and the like.

The particle size of charge generating materials such as selenium or alloys of selenium to be dispersed in the resin binder is preferably 5 μm or less, more preferably from 0.05 to 2 μm, and most preferably from 0.1 to 0.5 μm. If the particles are too coarse, there will result, for instance, an undesirably deteriorated stability of the coating solution therefore and the formation of coarse images.

In the above dispersion, there can be used ordinary organic solvents, such as methanol, ethanol, n-propanol, n-butanol, benzyl alcohol, methyl cellosolve, ethyl cellosolve, acetone, methyl ethyl ketone, cyclohexanone, methyl acetate, dioxane, tetrahydrofuran, methylene chloride, chloroform, etc. These solvents can be used either alone or in the form of a mixture of two or more of them.

The thickness of the charge generating layer in the electrophotographic photoreceptor of the present invention is preferably from 0.01 to 5 μm, and more preferably from 0.03 to 1.0 μm. If it is more than 5 μm, an undesirable decrease in chargeability, an increase in dark decay and an decrease in repeatstability may be resulted. If the layer is less than 0.01 μm, a low sensitivity will be resulted.

The charge transporting layer in the electrophotographic photoreceptor of the present invention comprises a resin binder containing a charge transporting material. As a charge transporting material, any known materials can be used. Examples of such materials include oxadiazole derivatives, such as 2,5-bis-(p-diethylaminophenyl)-1,3,4-oxadiazole, etc.; pyrazoline derivatives, such as 1,3,5-triphenylpyrazoline, 1-[pyridyl-(2)]-3-(p-diethylaminostyryl)-5-(p-diethylaminophenyl) pyrazoline, etc.; aromatic tertiary amino compounds, such as triphenylamine, dibenzylaniline, etc.; aromatic tertiary diamino compounds, such as N,N'-diphenyl-N-N'-bis-(3-methylphenyl)-[1,1'-diphenyl]-4,4'-diamine, etc; 1,2,4-triazine derivatives, such as 3-(4'-dimethylaminophenyl)-5,6-di-(4'-methoxyphenyl)-1,2,4-triazine, etc; hydrazone derivatives, such as 4-diethylaminobenzaldehyde-1,1'-diphenylhydrazone, etc.; quinazoline derivatives, such as 2-phenyl-4-styrylquinazoline, etc.; benzofuran derivatives, such as 6-hydroxy-2,3-di(p-methoxyphenyl)benzofuran, etc.; α-stylbene derivatives, such as p-(2,2-diphenylvinyl)-N,N-diphenylaniline, etc.; enamine derivatives, such as those described in Journal of Imaging Science, Vol 29, Pages 7–10 (1985); poly-N-vinylcarbazoles and derivatives thereof; such as poly-N-ethylcarbazoles, etc.; and poly-γ-carbazole ethylglutamate and derivatives thereof. It is also possible to use pyrene, polyvinyl pyrenes, polyvinylanthracenes, polyvinylacridines, poly-9-biphenylanthracenes, pyrene-formaldehyde resins, ethylcarbazole-formaldehyde resins, or the like. Charge transporting materials to be used in the invention are not limited to these, and they can be used either alone or in admixture.

In the charge transporting layer, any known resin binders can be used. Examples of usable resin binders include polycarbonate resins, polyester resins, polymethacrylate resins, polyacrylate resins, polyvinyl chloride resins, polyvinylidene chloride resins, polystyrene resins, polyvinyl acetate resins, styrenebutadiene copolymers, vinylidene chloride-acrylonitrile copolymers, vinyl chloride-vinyl acetate copolymers, vinyl chloride-vinyl acetate-maleic anhydride copolymers silicone resins, silicone-alkyd resins, phenolformaldehyde resins, styrene alkyd resins, poly-N-vinylcarbazoles, and the like. These resin binders can be used individually, or two or more of them can be used in combination.

The ratio, based on weight, of the charge transporting materials and the resin binders incorporated into the charge transporting layer is preferably from 10/1 to 1/5, and more preferably from 5/1 to 1/5. The thickness of the charge transporting layer is preferably from 5 to 50 μm, and more preferably from 10 to 30 μm.

Upon the formation of the charge transporting layer, one or more conventional organic solvents can be used. Examples of usable organic solvents include aromatic hydrocarbons, such as benzene, toluene, xylene, chlorobenzene, etc.; ketones, such as acetone, 2-butanone, etc.; halogenated fatty hydrocarbons, such as methylene chloride, chloroform, ethylene chloride, etc.; and cyclic and straight chain ethers, such as tetrahydrofuran, ethyl ether, etc. These solvents can be used either alone or in the form of a mixture of more than one of them.

If desired, a protective layer can be formed on the charge transporting layer. Such a protective layer can prevent chemical deterioration of the charge transporting layer at the time when the electrophotographic photoreceptor having a layered structure is charged. In addition, it also improves the mechanical strength of the electrophotographic photoreceptor.

Such a protective layer can be formed from a resin binder containing an appropriate conductive material. Examples of usable conductive materials include metallocene compounds, such as N,N'-dimethylferrocene, etc.; aromatic amino compounds, such as N,N'-diphenyl-N,N'-bis(3-methylphenyl) [1,1'-biphenyl]-4,4'-diamine, etc.; and metal oxides, such as antimony oxide, tin oxide, titanium oxide, indium oxide and tin oxide-antimony oxide. As a resin binder for the protective layer, known resins can be used, including, e.g., polyamide resins, polyurethane resins, polyester resins, epoxide resins, polyketone resins, polycarbonate resins, polyvinylketone resins, polystyrene and polyacrylamide resins.

The protective layer preferably has an electrical resistance of $1\times10^9$ to $1\times10^4$ Ω.cm. If its electrical resistance is greater than $1\times10^4$ Ω.cm, its residual voltage becomes undesirably high and, hence, fogging images will be formed. If it is less than $1\times10^9$ Ω.cm, blurred images will result having a lowered resolution. In addition, the protective layer must be so constituted that it does not substantially impede the passage of light to be utilized for the image-wise exposure.

The thickness of the protective layer is preferably from 0.5 to 20 μm and more preferably from 1 to 10 μm.

The above-described layers that constitute the electrophotographic photoreceptor of the present invention can be formed by any conventional coating method, including blade coating, wire bar coating, spray coating, dip coating, bead coating, air knife coating and curtain coating.

The following examples further illustrate preferred embodiments of the present invention. The examples should in no way be considered limiting, but are merely illustrative of the various features of the present invention.

EXAMPLE 1

A layered electrophotographic photoreceptor consisting of an aluminum substrate having thereon a charge generating layer and a charge transporting layer formed on the charge generating layer was prepared in the following manner.

A mixture consisting of 90 parts by weight of trigonal selenium (manufactured by Xerox Corp.); 10 parts by weight of partially acetoacetallized polyvinyl butyral resin [BX-1 manufactured by Sekisui Chemical Co., Ltd. which contained 65 mol % of unit A (acetoacetal, 40 mol %, and butyral, 25 mol %) and not more than 3 mol % of unit C]; and 300 parts by weight of n-butanol was dispersed in a ball mill for 24 hours, using ⅛ inch stainless steel balls. One (1) part by weight of the thus obtained dispersion was diluted with 2 parts by weight of n-butanol and stirred to prepare a dispersion for forming a charge generating layer. The resulting dispersion was coated onto an aluminum substrate by dip coating to form a charge generating layer having a thickness (after being dried) of 0.15 μm.

Then, 8 parts by weight of 4-diethylaminobenzaldehyde-1,1'-diphenylhydrazone wsa added to a solution of 12 parts by weight of polycarbonate resin (K-1300 manufactured by Teijin Kasei Co., Ltd.) and 80 parts by weight of dichloromethane to prepare a solution for forming a charge transporting layer. This solution was coated by dip coating onto the charge generating layer to form a charge transporting layer having a thickness (after being dried) of 25 μm.

The thus prepared electrophotographic photoreceptor was evaluated as follows.

The electrophotographic photoreceptor was charged, whereby the charging current was so controlled that the member will have a surface voltage of −800 volts after 1 sec. from the charging. After 0.3 sec. from the charging, a monochromatic light of 550 nm was exposed at an exposure amount of E (erg/cm$^2$), and its voltage was measured after 0.7 sec. from the exposure (i.e., after 1 sec. from the charging). The decay rates at −800 and −150 volts of its surface voltage, dV/dE, were calculated therefrom so as to evaluate the dependency of its photosensitivity on surface voltage. Results obtained are shown in Table 2.

The electrophotographic photoreceptor prepared above was mounted on a photocopying machine (a modified version of Model 2700 manufactured by Fuji Xerox Co., Ltd.), and duplicated images were formed. Excellent fog-free copies were obtained having a good reproducibility. Even when the duplication was repeated 10,000 times, the quality of the last copy was almost equal to that of the first copy.

EXAMPLES 2 AND 3

Electrophotographic photoreceptors were prepared by the same manner as in Example 1, except that the charge generating layer was formed by using the same trigonal selenium (a), partially acetoacetallized polyvinyl butyral resin (b) and n-butanol (c) in amounts shown in Table 1. These electrophotographic photoreceptors were evaluated by the same manner as in Example 1. Results obtained are shown in Table 2.

TABLE 1

| | (a) (Wt %) | (b) (Wt %) | (c) (Wt %) | Thickness of Charge Generating Layer (μm) |
|---|---|---|---|---|
| Example 2 | 80 | 20 | 300 | 0.2 |
| Example 3 | 70 | 30 | 500 | 0.3 |

EXAMPLE 4

An electrophotographic photoreceptor was prepared by the same manner as in Example 1, except that a partially formalized polyvinylbutyral resin [BX-2 manufactured by Sekisui Chemical Co., Ltd. which contained 65 mol % of unit A (formal, 20 mol % and butyral, 45 mol %) and not more than 3 mol % of unit C] was used in place of the partially acetoacetallized polyvinyl butyral resin (binder in the charge generating layer). The electrophotographic photoreceptor obtained was evaluated by the same manner as in Example 1. Results obtained are shown in Table 2.

Photocopies were produced by using the electrophotographic photoreceptor by the same manner as in Example 1. The quality of images obtained was equally excellent as compared with those obtained in Example 1.

EXAMPLE 5

An electrophotographic photoreceptor was prepared by the same manner as in Example 1, except that a polyvinyl butyral resin [BM-1 manufactured by Sekisui Chemical Co., Ltd. which contained 65 mol % of unit A (butyral only) and not more than 3 mol % of unit C] was used in place of the partially acetoacetallized polyvinyl butyral resin (binder in the charge generating layer). The electrophotographic photoreceptor obtained was evaluated by the same manner as in Example 1. Results obtained are shown in Table 2.

Photocopies were prepared by using the member in the same manner as in Example 1. The quality of the thus obtained copies was as excellent as those obtained in Example 1.

COMPARATIVE EXAMPLE 1-3

Electrophotographic photoreceptors were prepared by the same manner as in Example 1 (in the case of Comparative Example 1), Example 2 (in the case of Comparative Example 2) or Example 3 (in the case of Comparative Example 3), except that poly(N-vinylcarbazole) was used in place of the partially acetoacetallized polyvinyl butyral resin (binder in the charge generating layer) and tetrahydrofuran was used instead of n-butanol (solvent). The dependency of the photosensitivity on their surface voltage was evaluated by the same manner as in Example 1. Results obtained are shown in Table 2.

COMPARATIVE EXAMPLE 4-6

Electrophotographic photoreceptors were prepared by the same manner as in Example 1 (in the case of Comparative Example 4), Example 2 (in the case of Comparative Example 5) or Example 3 (in the case of Comparative Example 6), except that a phenoxy resin (PKHH manufactured by Union Carbide Corp.) was used in place of the partially acetoacetallized polyvinyl butyral resin (binder in the charge generating layer) and tetrahydrofuran was used instead of n-butanol (solvent). The dependency of the photosensitivity on their surface voltage was evaluated by the same manner as in Example 1. Results obtained are shown in Table 2.

TABLE 2

| | Resin Binder Used | Content of Selenium (Vol %) | dV/dE −800 V | dV/dE −150 V | Ratio of dV/dE at −150 V to That at −800 V |
|---|---|---|---|---|---|
| Example 1 | Partially Acetoacetallized Polyvinyl Butyral | 67 | 224 | 152 | 0.68 |
| Example 2 | Partially Acetoacetallized Polyvinyl Butyral | 48 | 217 | 145 | 0.67 |
| Example 3 | Partially Acetoacetallized Polyvinyl Butyral | 35 | 205 | 125 | 0.61 |
| Example 4 | Partially Formallized Polyvinyl Butyral | 48 | 220 | 132 | 0.60 |
| Example 5 | Polyvinyl Butyral | 48 | 215 | 123 | 0.57 |
| Comparative Example 1 | Poly(N-vinylcarbazole) | 69 | 250 | 90 | 0.36 |
| Comparative Example 2 | Poly(N-vinylcarbazole) | 50 | 241 | 84 | 0.35 |
| Comparative Example 3 | Poly(N-vinylcarbazole) | 37 | 235 | 78 | 0.33 |
| Comparative | Phenoxy Resin | 69 | 230 | 62 | 0.27 |

TABLE 2-continued

| | Resin Binder Used | Content of Selenium (Vol %) | dV/dE −800 V | dV/dE −150 V | Ratio of dV/dE at −150 V to That at −800 V |
|---|---|---|---|---|---|
| Example 4 | | | | | |
| Comparative Example 5 | Phenoxy Resin | 50 | 225 | 54 | 0.24 |
| Comparative Example 6 | Phenoxy Resin | 37 | 218 | 48 | 0.22 |

In Table 2, the nearer the ratio of dV/dE at −150 V to that at −800 V is to 1, the smaller is the dependency of the photosensitivity upon the surface voltage. As shown in Table 2, when a polyvinyl acetal resin is used as a resin binder, there can be obtained an electrophotographic photoreceptor having a ratio nearer to 1, that is to say, there can be obtained an electrophotographic photoreceptor having a photosensitivity less dependent upon surface voltage.

Thus, the electrophotographic photoreceptor of the present invention comprising the charge generating layer having the above structure has a photosensitivity less dependent on the surface potential, and further, can give copies having a good image quality and a good reproducibility.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor which comprises an electrically conductive substrate having thereon a charge generating layer and a charge transporting layer, wherein said charge generating layer comprises a polyvinyl acetal resin binder in which is dispersed a charge generating material of trigonal selenium, said polyvinyl acetal resin binder is a partially acetoacetallized polyvinyl butyral resin or a partially acetallized polyvinyl butyral resin in which a part of the butyral groups contained therein is substituted with one or more groups selected from the group consisting of a formal group, an acetoacetal group and a propional group, the content of trigonal selenium in said charge generating layer is from 30 to 80% by volume based on the total volume of said layer, and the thickness of the charge generating layer is from 0.01 to 5 μm.

2. The electrophotographic photoreceptor as claimed in claim 1, wherein the particle size of said trigonal selenium is 5 μm or less.

3. The electrophotographic photoreceptor as claimed in claim 1, wherein the particle size of said trigonal selenium is from 0.05 to 2 μm.

4. The electrophotographic photoreceptor as claimed in claim 1, wherein the particle size of said trigonal selenium is from 0.1 to 0.5 μm.

5. The electrophotographic photoreceptor as claimed in claim 1, wherein the ratio by weight of the charge transporting material to the resin binder is from 10/1 to 1/5.

6. The electrophotographic photoreceptor as claimed in claim 1, wherein the ratio by weight of the charge transporting material to the resin binder is from 5/1 to 1/5.

7. The electrophotographic photoreceptor as claimed in claim 1, wherein the thickness of the charge transporting layer is from 5 to 50 μm.

8. The electrophotographic photoreceptor as claimed in claim 1, wherein the thickness of the charge transporting layer is from 10 to 30 μm.

9. The electrophotographic photoreceptor as claimed in claim 1, wherein the thickness of the charge generating layer is from 0.03 to 1.0 μm.

* * * * *